US011673386B2

(12) United States Patent
Nishihara

(10) Patent No.: US 11,673,386 B2
(45) Date of Patent: Jun. 13, 2023

(54) MEASUREMENT METHOD OF NOZZLE OVERLAPPING WIDTH, AND INKJET RECORDING APPARATUS

(71) Applicant: KYOCERA Document Solutions Inc., Osaka (JP)

(72) Inventor: Masaaki Nishihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 90 days.

(21) Appl. No.: 17/612,983

(22) PCT Filed: Dec. 28, 2020

(86) PCT No.: PCT/JP2020/049174
§ 371 (c)(1),
(2) Date: Nov. 19, 2021

(87) PCT Pub. No.: WO2021/140993
PCT Pub. Date: Jul. 15, 2021

(65) Prior Publication Data

US 2022/0212465 A1 Jul. 7, 2022

(30) Foreign Application Priority Data

Jan. 7, 2020 (JP) ..... JP2020-000913

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586
See application file for complete search history.

(56) References Cited

U.S. PATENT DOCUMENTS 8,123,323 B2 * 2/2012 Jung ..... B41J 2/2146 347/14

FOREIGN PATENT DOCUMENTS

JP 2018-167417 A 11/2018
WO WO-2015156770 A1 * 10/2015 ..... B41J 2/0451

* cited by examiner

*Primary Examiner* — Thinh H Nguyen
(74) *Attorney, Agent, or Firm* — IP Business Solutions, LLC

(57) ABSTRACT

A measurement method of nozzle overlapping width, in a main scanning direction intersecting a conveying direction of a recording medium, in an inkjet recording apparatus including a plurality of heads each having a plurality of nozzles that eject ink, includes a first step (S120), a second step (S130), and a third step (S140). The first step (S120) includes forming an image for measurement on the recording medium, using image data including combination patterns of droplet sizes, different with respect to each of blocks extending along the main scanning direction. The second step (S130) includes selecting the block having uniform density along the main scanning direction, in the image for measurement. The third step (S140) includes determining the nozzle overlapping width using a droplet size ratio adopted to form the image for measurement, on a basis of a position of the selected block.

6 Claims, 8 Drawing Sheets

MEASUREMENT METHOD OF NOZZLE OVERLAPPING WIDTH, AND INKJET RECORDING APPARATUS

TECHNICAL FIELD

The present invention relates to a measurement method of nozzle overlapping width in an inkjet recording apparatus, and to the inkjet recording apparatus.

BACKGROUND ART

An inkjet recording apparatus according to Patent Literature (PTL) 1 includes a plurality of heads, each having a plurality of nozzles that eject ink. PTL 1 also discloses a measurement method of nozzle overlapping width in a main scanning direction, in increments of one pixel.

CITATION LIST

Patent Literature

PTL 1: Japanese Unexamined Patent Application Publication No. 2018-167417

SUMMARY OF INVENTION

Technical Problem

The inkjet recording apparatus according to PTL 1 is unable to measure the nozzle overlapping width, in increments smaller than one pixel.

The present invention has been accomplished in view of the foregoing situation, and provides a measurement method of nozzle overlapping width, in increments smaller than one pixel.

Solution to Problem

In an aspect, the present invention provides a measurement method of nozzle overlapping width, in a main scanning direction intersecting a conveying direction of a recording medium, in an inkjet recording apparatus including an image forming device, including a first head having a plurality of first nozzles aligned in a straight row, and a second head having a plurality of second nozzles aligned in a straight row, the image forming device being configured to eject ink on the recording medium thereby forming an image, and a controller that controls the image forming device. The measurement method includes a first step, a second step, and a third step. In the first head, the plurality of first nozzles are aligned along the main scanning direction. In the second head, the plurality of second nozzles are aligned in a same direction in which the plurality of first nozzles are aligned. The first head and the second head are arranged such that a part of the plurality of first nozzles and a part of the plurality of second nozzles are located adjacent to each other, with a spacing in the conveying direction. The first step includes causing the image forming device to form an image for measurement on the recording medium, using image data including combination patterns of droplet sizes, different with respect to each of blocks extending along the main scanning direction. The second step includes causing the controller to select the block having uniform density along the main scanning direction, in the image for measurement. The third step includes causing the controller to determine the nozzle overlapping width using a droplet size ratio adopted to form the image for measurement, on a basis of a position of the selected block.

In another aspect, the present invention provides an inkjet recording apparatus including an image forming device that ejects ink on a recording medium, thereby forming an image, a storage device, and a controller. The image forming device includes a first head having a plurality of first nozzles aligned in a straight row, and a second head having a plurality of second nozzles aligned in a straight row. The plurality of first nozzles in the first head are aligned along the main scanning direction, and the plurality of second nozzles in the second head are aligned in a same direction in which the plurality of first nozzles are aligned. The first head and the second head are arranged such that a part of the plurality of first nozzles and a part of the plurality of second nozzles are located adjacent to each other, with a spacing in the conveying direction. The storage device contains, in advance, image data including combination patterns of droplet sizes, different with respect to each of blocks extending along the main scanning direction. The controller (i) causes the image forming device to form the image for measurement on the recording medium, using the image data stored in the storage device, (ii) selects the block having uniform density along the main scanning direction, in the image for measurement, and (iii) determines the nozzle overlapping width using a droplet size ratio adopted to form the image for measurement, on a basis of a position of the selected block.

Advantageous Effects of Invention

With the arrangement according to the present invention, the measurement method of nozzle overlapping width, in increments smaller than one pixel, can be obtained.

DESCRIPTION OF EMBODIMENT

Figure 1:
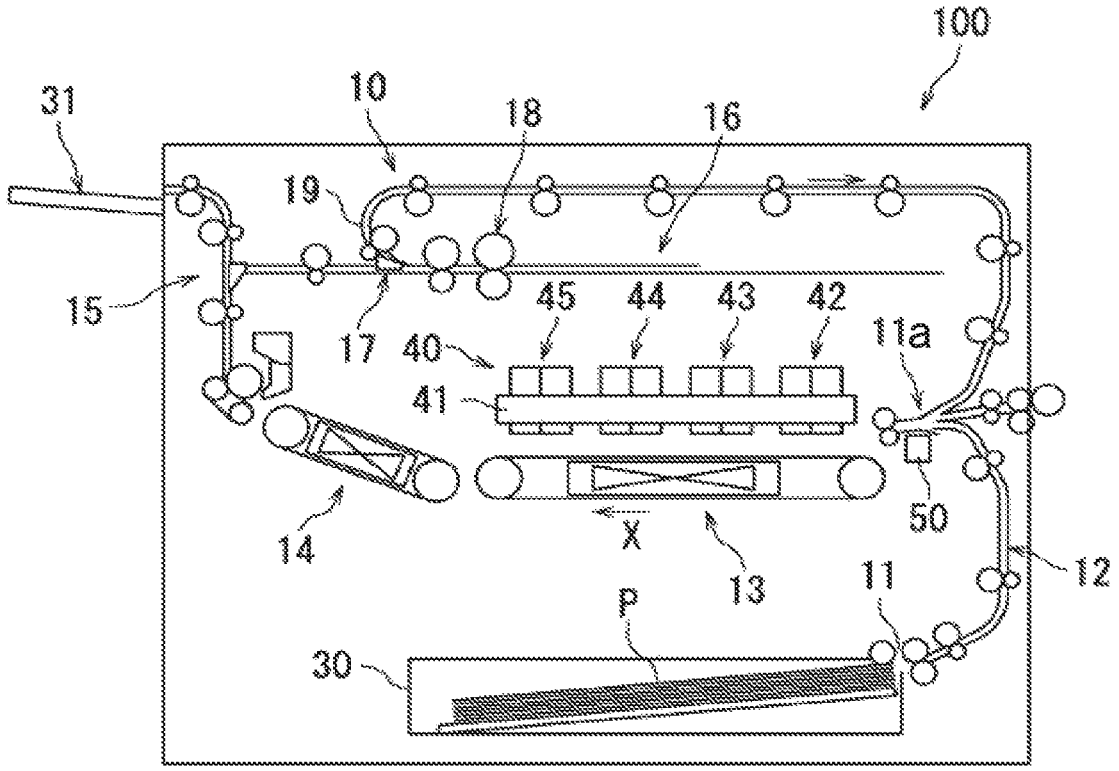
FIG. 1 is a schematic cross-sectional view showing an example of an inkjet recording apparatus, to which a measurement method of nozzle overlapping width according to an embodiment of the present invention is applied.

Referring to FIG. 1, an inkjet recording apparatus 100, to which a measurement method of nozzle overlapping width according to an embodiment of the present invention can be applied, will be described hereunder. FIG. 1 is a schematic cross-sectional view showing the inkjet recording apparatus 100.

As shown in FIG. 1, the inkjet recording apparatus 100 includes a conveyance device 10, a cassette 30, an output tray 31, an image forming device 40, and a reading device 50.

The conveyance device 10 includes a paper feeding device 11, a sheet conveyance path 12, a first belt conveyance section 13, a second belt conveyance section 14, a first conveyance path 15, a reverse conveyance path 16, a branching section 17, a reversing section 18, and a second conveyance path 19.

The cassette 30 is for accommodating sheets P therein. The paper feeding device 11 includes, for example, a pickup roller, and draws out the sheet P from the cassette 30 by driving the pickup roller, and delivers the sheet P to the sheet conveyance path 12. Examples of the usable sheet P include a plain paper, a thick paper, an OHP sheet, an envelope, and a postcard. The sheet P exemplifies the "recording medium" in the present invention.

The sheet conveyance path 12 includes various types of rollers, and guides the sheet P to the image forming device 40, by driving those rollers. To be more detailed, the sheet conveyance path 12 guides the sheet P delivered from the cassette 30 to the image forming device 40, through the first belt conveyance section 13. The image forming device 40 ejects the ink onto the sheet P, thereby forming an image on the sheet P. The second belt conveyance section 14 conveys the sheet P, on which the image has been formed by the image forming device 40.

The first conveyance path 15 includes various types of rollers, and guides the sheet P delivered from the second belt conveyance section 14 to the output tray 31, by driving those rollers. As result, the sheet P is delivered to the output tray 31.

The reverse conveyance path 16 is branched from the first conveyance path 15. The sheet P conveyed from the first conveyance path 15 toward the reverse conveyance path 16 is delivered to the branching section 17. The branching section 17 is located on the reverse conveyance path 16, and serves to guide the sheet P to the reversing section 18.

The reversing section 18 includes various types of rollers, and reverses the moving direction of the sheet P so as to deliver the sheet P to the branching section 17, by driving those rollers. The branching section 17 guides the sheet P delivered from the reversing section 18, to the second conveyance path 19. The second conveyance path 19 includes various types of rollers, and guides the sheet P to the sheet conveyance path 12, by driving those rollers. Accordingly, the sheet P that has passed the image forming device 40 is guided to a return position 11*a*, through the second conveyance path 19. The return position 11*a* is set on the sheet conveyance path 12, at a position upstream of the image forming device 40, in the conveying direction X of the sheet P. The conveying direction X of the sheet P refers to the direction in which the sheet P moves, when the image forming device 40 forms an image on the sheet P.

The sheet P guided to the return position 11*a* is again conveyed to the image forming device 40. At this point, the front face and the back face of the sheet P, guided to the return position 11*a*, are reversed. Accordingly, the image forming device 40 forms an image on the back face of the sheet P.

The reading device 50 is located between the image forming device 40 and the return position 11*a*. The reading device 50 scans the sheet P, thereby reading the image on the sheet P. The reading device 50 is, for example, constituted of a contact image sensor (CIS) unit. The reading device 50 is located under the sheet conveyance path 12.

Figure 2:
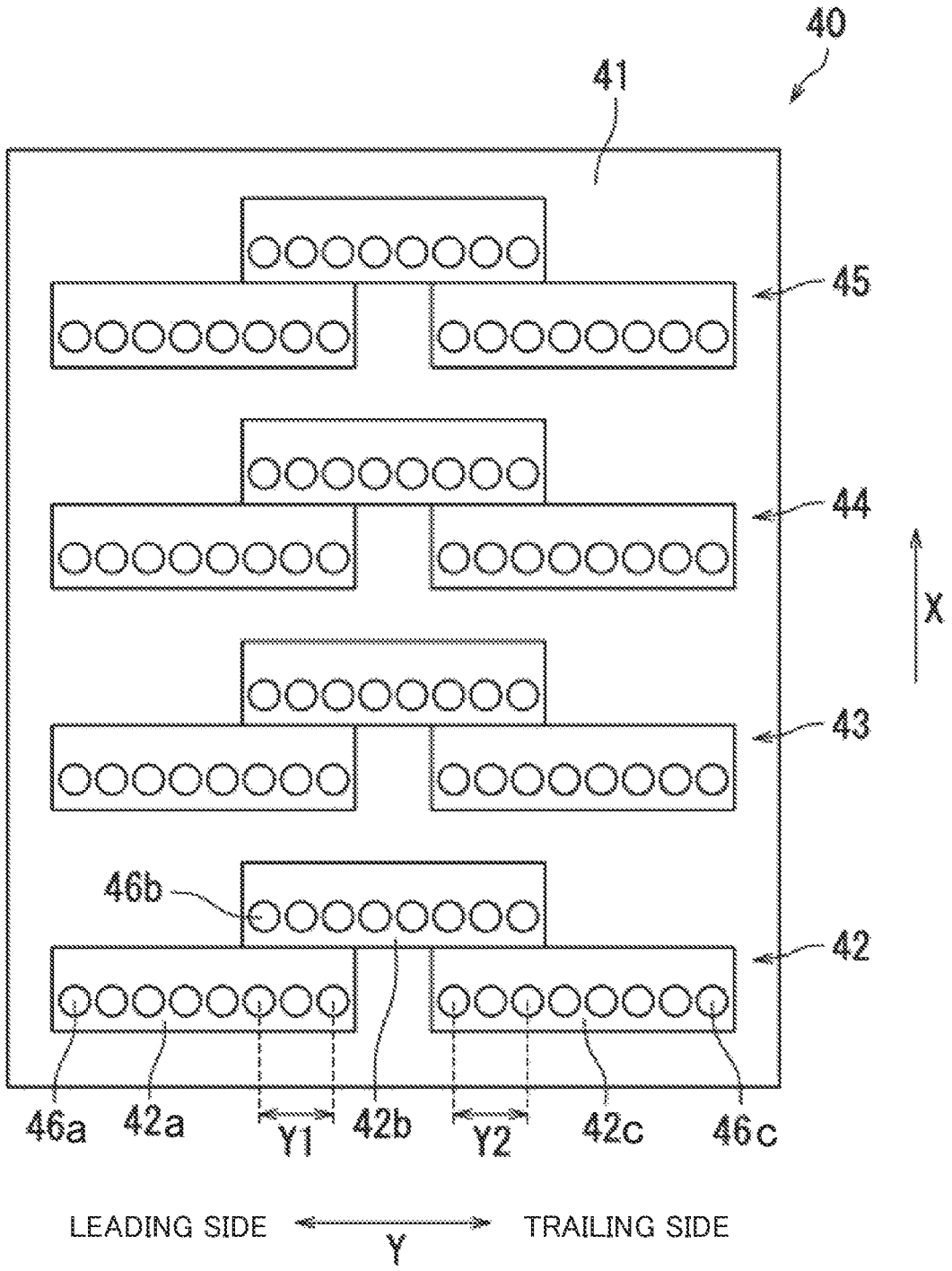
FIG. 2 is a schematic drawing showing an image forming device viewed from below.

Referring to FIG. 1 and FIG. 2, the image forming device 40 will be described hereunder. FIG. 2 illustrates the image forming device 40 viewed from below. In other words, FIG. 2 illustrates the image forming device 40 viewed from the side of the first belt conveyance section 13.

As shown in FIG. 2, the image forming device 40 includes a housing 41, and a plurality of head units. The housing 41 supports the plurality of head units. The plurality of head units include, for example, a first head unit 42, a second head unit 43, a third head unit 44, and a fourth head unit 45. The plurality of head units are each opposed to the first belt conveyance section 13. The plurality of head units are aligned along the conveying direction X. To each of the plurality of head units, ink is supplied. The ink color differs with respect to each of the head units. To the first head unit 42, for example, black ink is supplied. To the second head unit 43, for example, cyan ink is supplied. To the third head unit 44, for example, magenta ink is supplied. To the fourth head unit 45, for example, yellow ink is supplied.

The plurality of head units, namely the first head unit 42, the second head unit 43, the third head unit 44, and the fourth head unit 45, have the same structure as each other. Therefore, the structure of the first head unit 42 will be described hereunder, and the description of other head units will be skipped.

The first head unit 42 includes a plurality of heads and a plurality of nozzles. The plurality of heads include, for example, a first head 42*a*, a second head 42*b*, and a third head 42*c*. The plurality of heads are aligned along a main scanning direction Y, in a checkerboard pattern. The main scanning direction Y refers to a direction intersecting the conveying direction X of the sheet P. The plurality of heads each include the plurality of nozzles. The plurality of nozzles include, for example, a plurality of first nozzles 46*a*, a plurality of second nozzles 46*b*, and a plurality of third nozzles 46*c*. The first head 42*a* includes the plurality of first nozzles 46*a*. The second head 42*b* includes the plurality of second nozzles 46*b*. The third head 42*c* includes the plurality of third nozzles 46*c*. The plurality of nozzles are each opposed to the first belt conveyance section 13. The first head 42*a*, the second head 42*b*, and the third head 42*c* exemplify the "plurality of heads" in the present invention. The plurality of first nozzles 46*a*, the plurality of second nozzles 46*b*, and the plurality of third nozzles 46*c* each exemplify the "plurality of nozzles" in the present invention.

The plurality of first nozzles 46*a* and the plurality of second nozzles 46*b* include a first overlapping width Y1. The first overlapping width Y1 refers to the size in the main scanning direction Y, of the respective portions of the plurality of first nozzles 46*a* and the plurality of second nozzles 46*b* overlapping in the main scanning direction Y. The plurality of second nozzles 46*b* and the plurality of third nozzles 46*c* include a second overlapping width Y2. The second overlapping width Y2 refers to the size in the main scanning direction Y, of the respective portions of the plurality of second nozzles 46*b* and the plurality of third nozzles 46*c* overlapping in the main scanning direction Y. The first overlapping width Y1 and the second overlapping width Y2 each exemplify the "nozzle overlapping width" in the present invention.

The plurality of first nozzles 46*a* are aligned along the main scanning direction Y. One of the plurality of first nozzles 46*a* at the leading position is located at the left end in FIG. 2. The trailing one of the first nozzles 46*a* is located at the right end in FIG. 2. Accordingly, the plurality of first nozzles 46*a* are aligned from the left end toward the right end in FIG. 2. With respect to the main scanning direction Y, the left side in FIG. 2 will be defined as a leading side, and the right side in FIG. 2 will be defined as a trailing side.

The plurality of second nozzles 46*b* are aligned in the same direction as the plurality of first nozzles 46*a*. Accordingly, the leading one of the plurality of second nozzles 46*b* is located at the left end in FIG. 2. The trailing one of the plurality of second nozzles 46*b* is located at the right end in FIG. 2. Therefore, the plurality of second nozzles 46*b* are aligned from the left end toward the right end, in FIG. 2.

A part of the plurality of second nozzles 46*b* on the leading side, and a part of the plurality of first nozzles 46*a* on the trailing side, are located adjacent to each other in the conveying direction X, with a spacing therebetween. Here, the expression "adjacent in the conveying direction X with a spacing" refers to a state where the nozzles are located at different positions in the conveying direction X, and at the same position in the main scanning direction Y.

The plurality of third nozzles 46*c* are aligned in the same direction as the plurality of second nozzles 46*b*. Accordingly, the leading one of the plurality of third nozzles 46*c* is located at the left end in FIG. 2. The trailing one of the plurality of third nozzles 46*c* is located at the right end in FIG. 2. Therefore, the plurality of third nozzles 46*c* are aligned from the left end toward the right end, in FIG. 2.

A part of the plurality of third nozzles 46*c* on the leading side, and a part of the plurality of second nozzles 46*b* on the trailing side, are located adjacent to each other in the conveying direction X, with a spacing therebetween.

The plurality of heads, namely the first head 42*a*, the second head 42*b*, and the third head 42*c* are each configured to transmit a pressure, generated by deformation of a piezoelectric element, to the ink in each of the nozzles, thereby oscillating a meniscus and generating an ink droplet. As result, the plurality of nozzles, namely the plurality of first nozzles 46*a*, the plurality of second nozzles 46*b*, and the plurality of third nozzles 46*c* each eject the ink.

The respective nozzles of the plurality of head units, namely the first head unit 42, the second head unit 43, the third head unit 44, and the fourth head unit 45 eject the ink onto the sheet P, adsorbed to the first belt conveyance section 13. As result, a color image, composed of the four color inks of cyan, magenta, yellow, and black superposed on each other, is formed on the sheet P.

Figure 3:
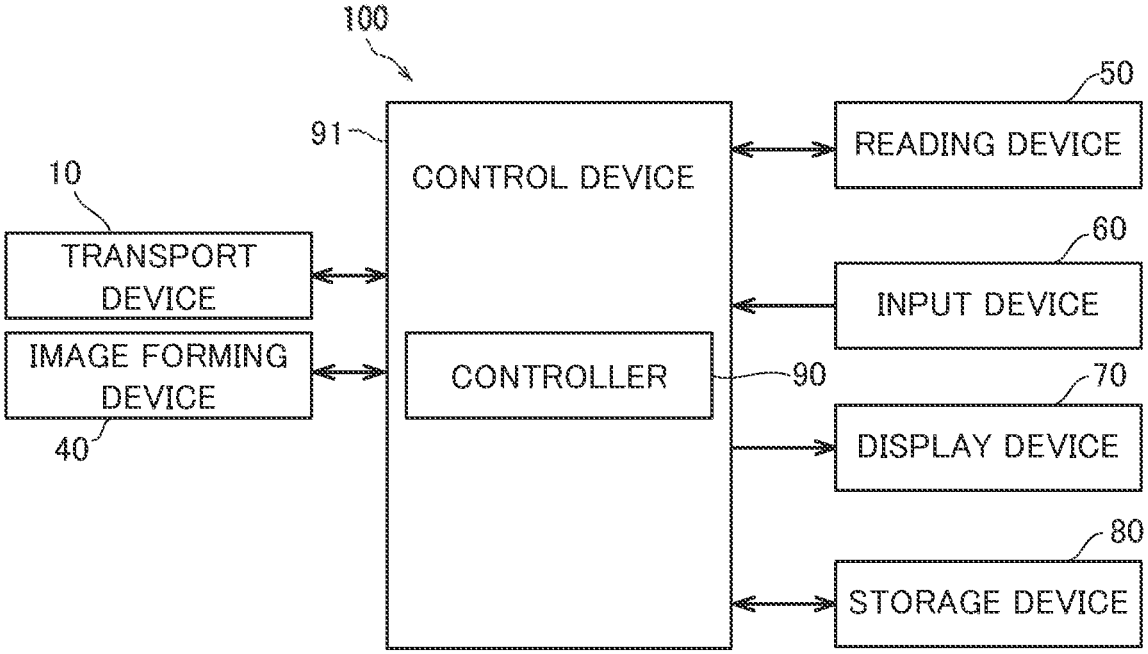
FIG. 3 is a functional block diagram showing an electrical configuration of the inkjet recording apparatus.

Referring now to FIG. 1 and FIG. 3, an electrical configuration of the inkjet recording apparatus 100 will be described hereunder. FIG. 3 is a functional block diagram showing the electrical configuration of the inkjet recording apparatus.

As shown in FIG. 3, the inkjet recording apparatus 100 also includes an input device 60, a display device 70, a storage device 80, and a controller 90.

The input device 60 receives instructions from the user, directed to the inkjet recording apparatus 100. The input device 60 includes, for example, a touch panel or physical keys including operating keys.

The display device 70 is, for example, constituted of a liquid crystal display (LCD), or an organic electroluminescence display (ELD). The display device 70 may be unified with the input device 60. In this case, the input device 60 and the display device 70 are constituted of a touch panel.

The storage device 80 includes memory units. The memory units include main memory units (e.g., semiconductor memory) such as a Read-Only Memory (ROM), and a Random-Access Memory (RAM), and may further include an auxiliary memory unit (e.g., hard disk drive). The main memory unit contains various computer programs, to be executed by the controller 90.

The control device 91 includes a processor, a RAM, a ROM, and so forth. The processor is, for example, a central processing unit (CPU), an application-specific integrated circuit (ASIC), or a microprocessing unit (MPU). The control device 91 acts as the controller 90, when the processor executes the control program stored in the ROM or the storage device 80.

The controller 90 controls the overall operation of the inkjet recording apparatus 100. The control device 91 is connected to the conveyance device 10, the image forming device 40, the reading device 50, the input device 60, the display device 70, and the storage device 80. The controller 90 controls the operation of the cited constituent elements, and transmits and receives signals and data to and from the constituent elements. The controller 90 controls each of the constituent elements of the inkjet recording apparatus 100. More specifically, the controller 90 controls the conveyance device 10, the image forming device 40, the reading device 50, the input device 60, the display device 70, and the storage device 80.

Figure 4:
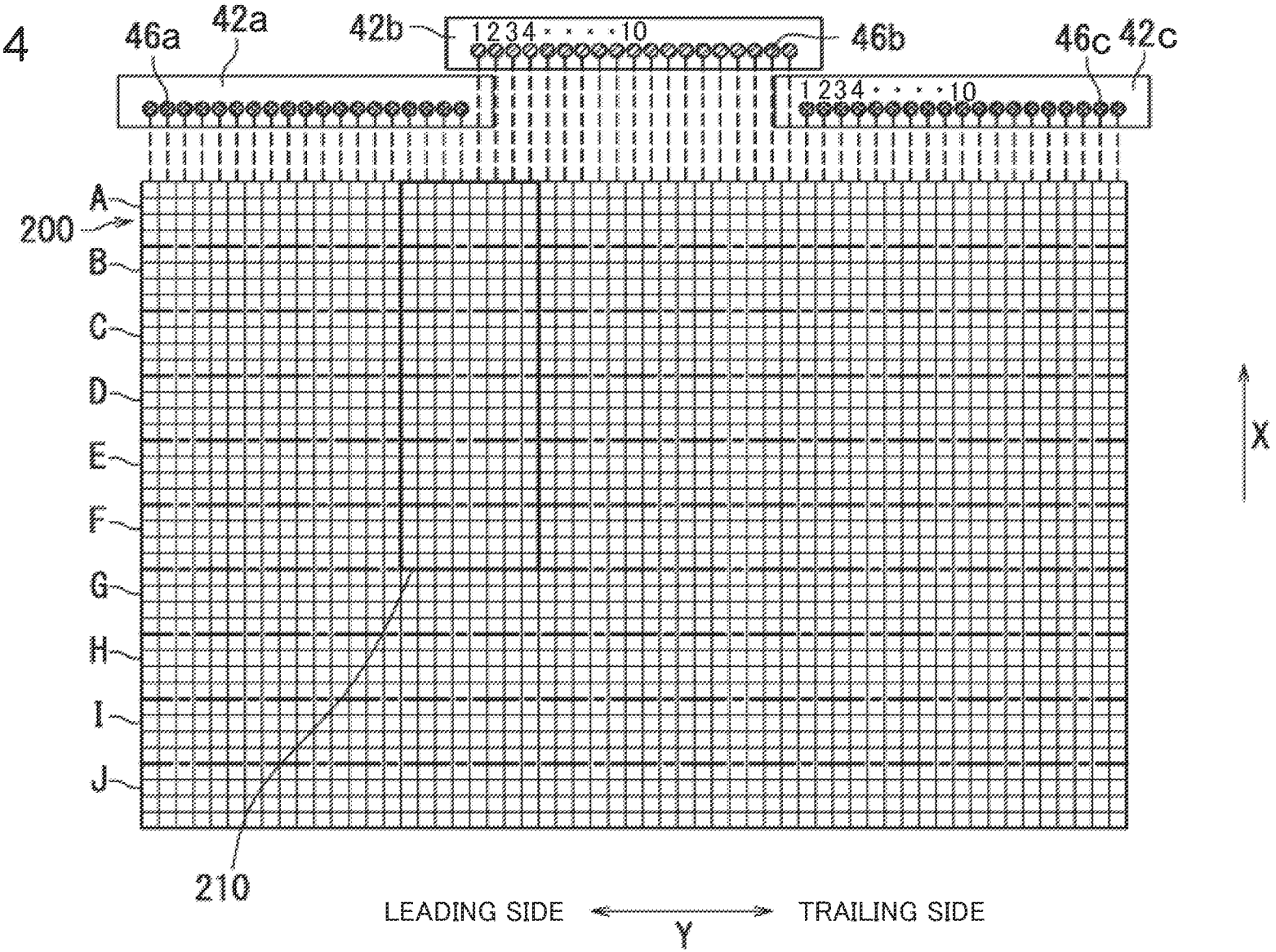
FIG. 4 is a schematic drawing showing an example of image data stored in a storage device.
Figure 5:
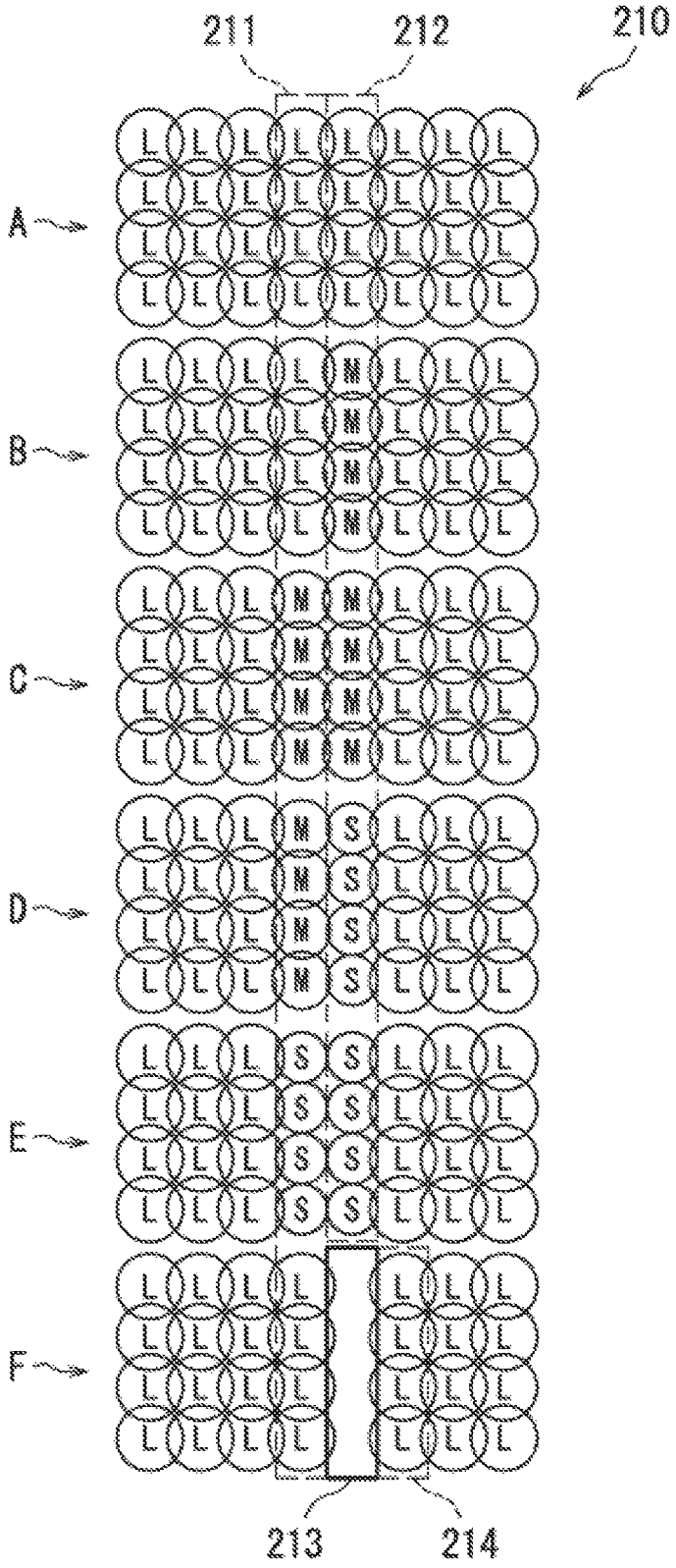
FIG. 5 is an enlarged view of partial data in FIG. 4.

Referring to FIG. 4 and FIG. 5, image data 200, generated by the controller 90 and stored in the storage device 80, will be described hereunder. FIG. 4 illustrates an example of the image data 200. FIG. 5 is an enlarged view of partial data 210 in FIG. 4.

The controller 90 generates the image data 200, in a form illustrated in FIG. 4. As shown in FIG. 4, the image data 200 is formed so as to operate all of the plurality of first nozzles 46*a*, the plurality of second nozzles 46*b*, and the plurality of third nozzles 46*c*, in a predetermined pattern. The image data 200 is generated by defining virtual positions of the plurality of first nozzles 46*a* and the plurality of second nozzles 46*b*, so as to cancel the first overlapping width Y1 (i.e., make the first overlapping width Y1 "0") between the plurality of first nozzles 46*a* and the plurality of second nozzles 46*b*, and defining virtual positions of the plurality of second nozzles 46*b* and the plurality of third nozzles 46*c*, so as to cancel the second overlapping width Y2 (i.e., make the second overlapping width Y2 "0") between the plurality of second nozzles 46*b* and the plurality of third nozzles 46*c*.

The image data 200 is, for example, divided into a plurality of blocks each including four lines. Each of the blocks corresponds to an image of a belt-like shape, extending along the main scanning direction Y. As examples of the blocks, a first block A, a second block B, a third block C, a fourth block D, a fifth block E, a sixth block F, a seventh block G, an eighth block H, a ninth block I, and a tenth block J are illustrated in FIG. 4.

The image data 200 includes partial data 210. The partial data 210 represents the data corresponding to a predetermined number of first nozzles 46*a* (e.g., 4) on the trailing side, out of the plurality of first nozzles 46*a*, and a predetermined number of second nozzles 46*b* (e.g., 4) on the leading side, out of the plurality of second nozzles 46*b*, in each of the first block A to the sixth block F.

As shown in FIG. 5, in the portion of the partial data 210 included in the first block A, a large droplet size L is allocated to a trailing pixel group 211 corresponding to the first nozzle 46*a*, and the large droplet size L is also allocated to a leading pixel group 212 corresponding to the second nozzle 46*b*. This combination of the droplet size will be referred to as "LL pattern".

In the portion of the partial data 210 included in the second block B, the large droplet size L is allocated to the trailing pixel group 211, and a medium droplet size M is allocated to the leading pixel group 212. This combination of the droplet size will be referred to as "LM pattern".

In the portion of the partial data 210 included in the third block C, the medium droplet size M is allocated to the trailing pixel group 211, and the medium droplet size M is also allocated to the leading pixel group 212. This combination of the droplet size will be referred to as "MM pattern".

In the portion of the partial data 210 included in the fourth block D, the medium droplet size M is allocated to the trailing pixel group 211, and a small droplet size S is allocated to the leading pixel group 212. This combination of the droplet size will be referred to as "MS pattern".

In the portion of the partial data 210 included in the fifth block E, the small droplet size S is allocated to the trailing pixel group 211, and the small droplet size S is also allocated to the leading pixel group 212. This combination of the droplet size will be referred to as "SS pattern".

In the portion of the partial data 210 included in the sixth block F, the large droplet size L is allocated to the trailing pixel group 211 corresponding to the first nozzle 46*a*, and a blank is allocated to a leading pixel group 213 corresponding to the second nozzle 46*b*. Further, the large droplet size L is allocated to a second pixel group 214 corresponding to the second nozzle 46*b*.

Though not illustrated, the LL, LM, MM, MS, and SS patterns are respectively allocated, with a blank row interposed therein, in the sixth block F to the tenth block J. Further, in the case where the image data includes an eleventh block to a fifteenth block, the LL, LM, MM, MS, and SS patterns are respectively allocated, with two blank rows interposed therein.

The portion of the image data 200 including the boundary between the trailing side of the plurality of second nozzles 46*b*, and the leading side of the plurality of third nozzles 46*c*, also includes combination patterns of the droplet size, which are different with respect to each of the blocks extending along the main scanning direction Y.

To the remaining pixels included in the image data 200, the large droplet size L is allocated.

Figure 6:
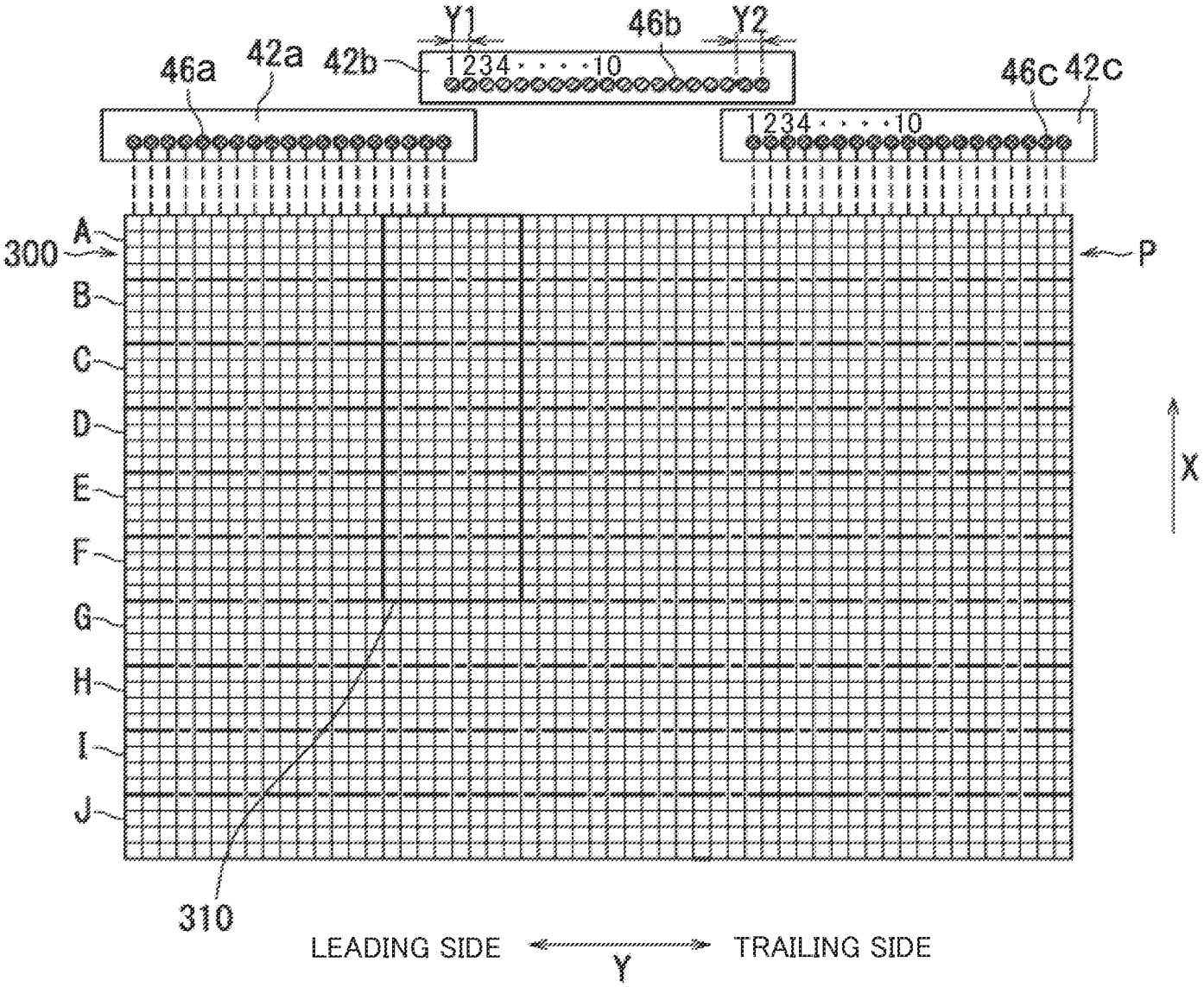
FIG. 6 is a schematic drawing showing an example of an image for measurement formed on a sheet.
Figure 7:
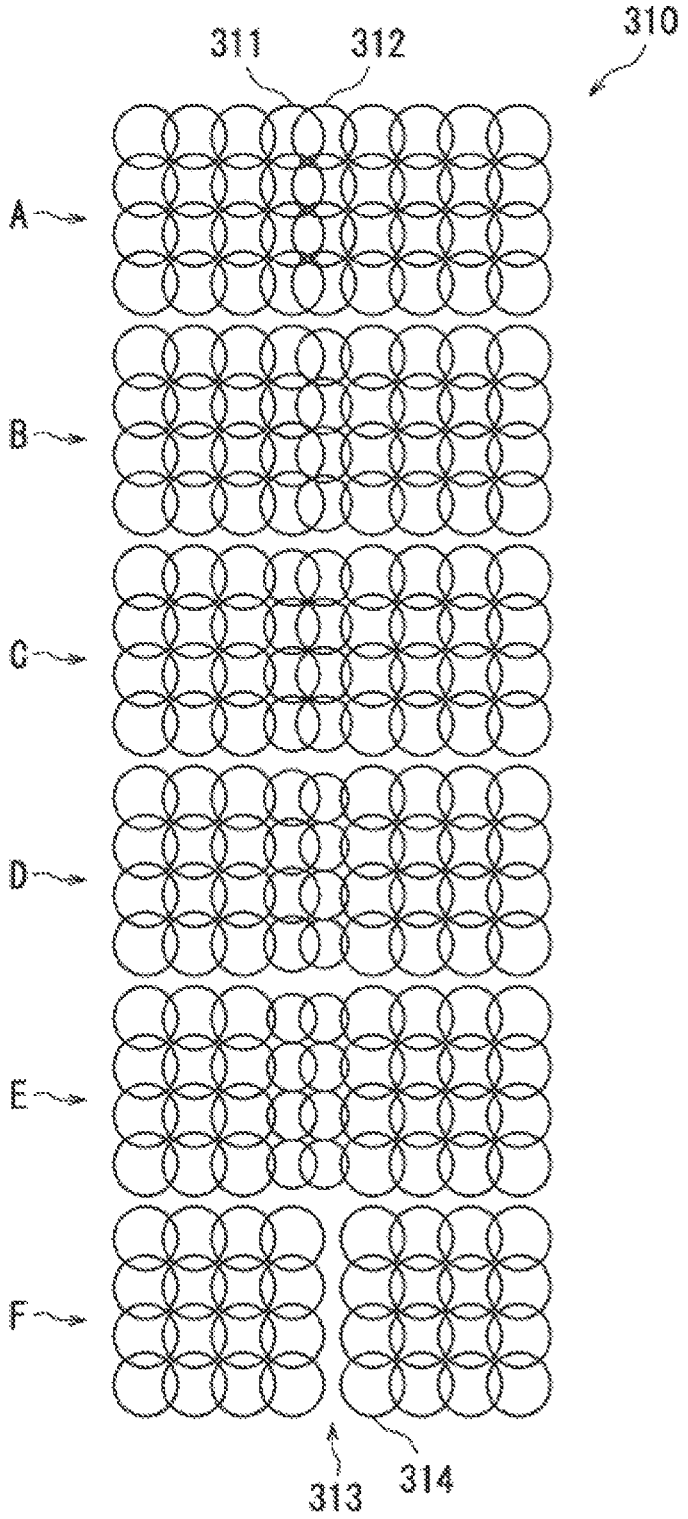
FIG. 7 is an enlarged view of a partial image in FIG. 6.

Referring now to FIG. 6 and FIG. 7, an image for measurement 300, formed on the sheet P by the image forming device 40, on the basis of the image data 200 under the control of the controller 90, will be described hereunder. FIG. 6 is a schematic drawing showing an example of the image for measurement 300. FIG. 7 is an enlarged view of a partial image 310 in FIG. 6.

In the inkjet recording apparatus 100 according to the embodiment, as shown in FIG. 6, the plurality of first nozzles 46*a* and the plurality of second nozzles 46*b* define a first overlapping width Y1. Likewise, the plurality of second nozzles 46*b* and the plurality of third nozzles 46*c* define a second overlapping width Y2. For example, the first overlapping width Y1 corresponds to 0.8 times of the pixel pitch, and the second overlapping width Y2 corresponds to 1.2 times of the pixel pitch, which can be expressed as Y1=0.8 pixel, and Y2=1.2 pixel.

The image for measurement 300 includes the partial image 310. The partial image 310 represents the image corresponding to four first nozzles 46*a* on the trailing side, out of the plurality of first nozzles 46*a*, and five second nozzles 46*b* on the leading side, out of the plurality of second nozzles 46*b*, in each of the first block A to the sixth block F.

As shown in FIG. 7, a trailing pixel group 311 corresponding to the first nozzles 46*a* and a leading pixel group 312 corresponding to the second nozzles 46*b* largely overlap, in a portion of the partial image 310 corresponding to the first block A to the fourth block D, and therefore the density is increased in the overlapping portion, compared with the remaining portion. The portion of the higher density is recognized as a black line, by the user.

In the portion of the partial image 310 corresponding to the sixth block F, a blank portion is left between the trailing pixel group 311 corresponding to the first nozzles 46*a* and a second leading pixel group 314 corresponding to the second nozzles 46*b*. The blank portion is defined by a leading pixel group 313 corresponding to the second nozzles 46*b*. The blank portion is recognized as a white line, by the user.

In the portion of the partial image 310 corresponding to the fifth block E, in contrast, the image is formed (printed) in uniform density along the main scanning direction Y, without the black line and the white line. Accordingly, the user can select the fifth block E, to which the SS pattern is allocated, as the block having uniform density along the main scanning direction Y, in the image for measurement 300.

Upon receipt of the notice that the fifth block E, to which the SS pattern is allocated, has been selected, the controller 90 determines the nozzle overlapping width according to the following equation [1], using the droplet size ratio adopted to form the image for measurement 300:

$$\text{Nozzle overlapping width} = 2 - (\text{total of droplet size of each pattern})/(L\ \text{size}) \quad [1]$$

On the assumption that, as an example, the droplet size ratio L/M/S is specified as 1.0/0.8/0.6, the nozzle overlapping width Y1 is determined as 0.8 pixel, as calculated with the equation [1] as below:

$$Y1 = 2 - (\text{total of droplet size of } SS \text{ pattern})/(L\ \text{size}) = 2 - (0.6 + 0.6)/1.0 = 0.8$$

When the droplet size ratio L/M/S is specified as 1.0/0.8/0.6 as above, the nozzle overlapping width Y1 is determined as 0.2 pixel with respect to the LM pattern, as 0.4 pixel with respect to the MM pattern, and as 0.6 pixel with respect to the MS pattern, according to the equation [1].

In addition, the user can select the seventh block G, as the block having uniform density along the main scanning direction Y in the image for measurement 300, with respect to the overlapping portion between the plurality of second nozzles 46*b* and the plurality of third nozzles 46*c*. In the seventh block G, the LM pattern is allocated with one blank row interposed therein.

In this case, the controller 90 adds "one pixel" corresponding to the blank row, to 0.2 pixel calculated as the nozzle overlapping width Y2 according to the equation [1], thereby determining the nozzle overlapping width Y2 as 1.2 pixel.

Figure 8:
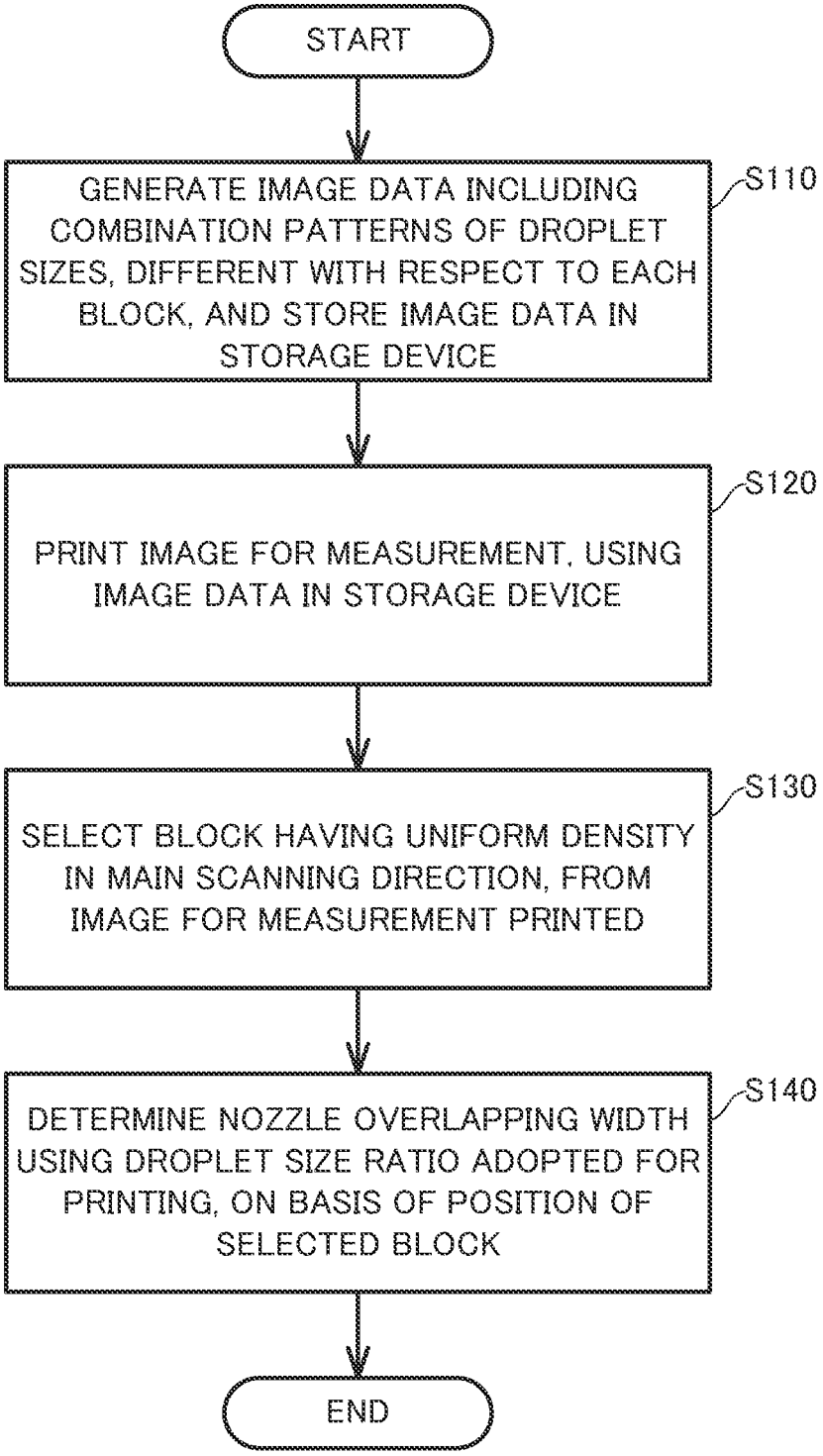
FIG. 8 is a flowchart showing an example of an operation performed by a controller.

An operation of the controller 90 will now be described, with reference to FIG. 8. FIG. 8 is a flowchart showing an example of the operation performed by the controller 90.

Step S110: As shown in FIG. 8, the controller 90 generates the image data 200 including the combination patterns of the droplet sizes, which are different with respect to each of the blocks extending along the main scanning direction Y, and stores the image data 200 in the storage device 80.

Step S120: The controller 90 causes the image forming device 40 to form the image for measurement 300 on the sheet P, using the image data 200 stored in the storage device 80.

Step S130: The user selects the block having uniform density along the main scanning direction, in the image for measurement 300 that has been formed. The result of the user's selection is notified to the controller 90, through the input device 60. The controller 90 selects, according to the notice, the block having uniform density along the main scanning direction, in the image for measurement 300.

Step S140: The controller 90 determines the first overlapping width Y1 and the second overlapping width Y2, using the droplet size ratio adopted for the image forming (printing) of the image for measurement 300, on the basis of the position of the selected block.

The arrangement according to this embodiment enables the nozzle overlapping width, namely the first overlapping width Y1 and the second overlapping width Y2, to be measured, for example, in increments of 0.2 pixel. Therefore, the measurement method of the nozzle overlapping width, in increments smaller than one pixel, can be obtained.

By utilizing the measurement result obtained through the measurement method of the nozzle overlapping width described as above, each of the first overlapping width Y1 and the second overlapping width Y2 can be adjusted to "0", without the need to adjust the respective positions of the plurality of heads, namely the first head 42*a*, the second head 42*b*, and the third head 42*c*.

To be more detailed, when the result "Y1=0.8 pixel" is obtained as above with respect to the first overlapping width Y1, the controller 90 performs, thereafter, gradation correction based on the overlapping width corresponding to 0.8 pixel, with respect to the trailing one of the plurality of first nozzles 46*a* and the leading one of the plurality of second nozzles 46*b*. As result, the first overlapping width Y1, between the ink ejected from the plurality of first nozzles 46*a* and the ink ejected from the plurality of second nozzles 46*b*, can be adjusted to "0" on the sheet P, without the need to adjust the respective positions of the first head 42*a* and the second head 42*b*. Likewise, when the result "Y2=1.2 pixel" is obtained as above with respect to the second overlapping width Y2, the controller 90 thereafter restricts the leading one of the plurality of third nozzles 46*c* from ejecting the ink, and performs the gradation correction based on the overlapping width corresponding to 0.2 pixel, with respect to the trailing one of the plurality of second nozzles 46*b* and the second leading one of the plurality of third nozzles 46*c*. As result, the second overlapping width Y2, between the ink ejected from the plurality of second nozzles 46*b* and the ink ejected from the plurality of third nozzles 46*c*, can be adjusted to "0" on the sheet P, without the need to adjust the respective positions of the second head 42*b* and the third head 42*c*.

According to the foregoing embodiment, in addition, the image data 200 includes the combination patterns of the three droplet sizes of large, medium, and small, with respect to a part of the plurality of first nozzles 46*a* (four on the trailing side) and a part of the plurality of second nozzles 46*b* (four on the leading side), and also a part of the plurality of second nozzles 46*b* (four on the trailing side) and a part of the plurality of third nozzles 46*c* (four on the leading side). Accordingly, when a droplet size ratio appropriate for the type of the sheet P is determined, the nozzle overlapping width can be accurately measured, using the image for measurement 300 formed on the basis of the image data 200.

Here, the user may be exempted from deciding the density, and instead the reading device 50 may read the image for measurement 300, and the controller 90 may decide the density. In this case, referring to FIG. 1, the sheet P on which the image for measurement 300 has been formed (printed) is guided to the return position 11*a*, through the second conveyance path 19. Then the reading device 50 reads the image for measurement 300 formed on the sheet P. The controller 90 selects the block having uniform density along the main scanning direction Y, in the image for measurement 300 read by the reading device 50. For example, the controller 90 may decide the density with respect to each of the first block A to the fifth block E, in the partial image 310 shown in FIG. 6, read by the reading device 50, and identify the block having uniform density along the main scanning direction Y, thereby selecting the fifth block E to which the SS pattern is allocated, as the block having uniform density along the main scanning direction Y in the image for measurement 300.

The embodiment of the present invention has been described as above, with reference to the drawings. However, the present invention is not limited to the foregoing embodiment, but may be implemented in various manners without departing from the scope of the present invention. The plurality of constituent elements disclosed in the foregoing embodiment may be combined as desired, to achieve various inventions. For example, some constituent elements may be excluded, from those disclosed in the foregoing embodiment. The drawings each schematically illustrate the essential constituent elements for the sake of clarity, and the number of pieces of each of the constituent elements illustrated may differ from the actual ones, depending on the convenience in making up the drawings. Further, the constituent elements described in the foregoing embodiment are merely exemplary, and may be modified in various manners without substantially departing from the effects expected from the present invention.

For example, although the controller 90 generates the image data 200 in the foregoing embodiment, a different arrangement may be adopted. The controller 90 may retrieve the image data 200, from outside of the inkjet recording apparatus 100.

Although the image data 200 according to the embodiment includes the combination patterns of the three droplet sizes of large, medium, and small, a different combination pattern may be adopted. The image data 200 may include the combination patterns of four or more droplet sizes.

Further, although each of the blocks in the image data 200 is composed of four lines in the foregoing embodiment, a different arrangement may be adopted. In the case where the blocks are each composed of five or more lines, the image data 200 may be modified such that the alphabets are displayed as the block identification mark, with respect to each of such blocks.

Further, the configurations and processings described in the foregoing embodiments with reference to FIG. 1 to FIG. 8 are merely exemplary, and in no way intended to limit the present invention to those configurations and processings.

The invention claimed is:

1. A measurement method of nozzle overlapping width, in a main scanning direction intersecting a conveying direction of a recording medium, in an inkjet recording apparatus including an image forming device, including a first head having a plurality of first nozzles aligned in a straight row, and a second head having a plurality of second nozzles aligned in a straight row, the image forming device being configured to eject ink on the recording medium thereby forming an image, and a controller that controls the image forming device, the plurality of first nozzles in the first head being aligned along the main scanning direction, the plurality of second nozzles in the second head being aligned in a same direction in which the plurality of first nozzles are aligned, the first head and the second head being arranged such that a part of the plurality of first nozzles and a part of the plurality of second nozzles are located adjacent to each other, with a spacing in the conveying direction, the measurement method comprising:

a first step including causing the image forming device to form an image for measurement on the recording medium, using image data including combination patterns of droplet sizes, different with respect to each of blocks extending along the main scanning direction;

a second step including causing the controller to select the block having uniform density along the main scanning direction, in the image for measurement; and a third step including causing the controller to determine the nozzle overlapping width using a droplet size ratio adopted to form the image for measurement, on a basis of a position of the selected block.

2. The measurement method according to claim 1, further comprising a step including causing the controller to generate the image data.

3. The measurement method according to claim 1, wherein the image data specifies a virtual position of each of the plurality of first nozzles and the plurality of second nozzles, determined so as to cancel the overlapping width between the plurality of first nozzles and the plurality of second nozzles, and includes the combination patterns of three droplet sizes of large, medium, and small, with respect to a part of the plurality of first nozzles and a part of the plurality of second nozzles.

4. The measurement method according to claim 3, wherein the three droplet sizes of large, medium, and small, include a large droplet size L (=1.0), a medium droplet size M (=0.8), and a small droplet size S (=0.6), and the third step includes causing the controller to determine the nozzle overlapping width, using the droplet size ratio adopted to form the image for measurement, on a basis of the position of the block selected in the second step, with a computing equation expressed as:

Nozzle overlapping width=2−(total of the droplet size of the pattern of the selected block)/*L*, where the droplet size ratio *L/M/S* is specified as 1.0/0.8/0.6.

5. The measurement method according to claim 1, wherein the second step includes causing a reading device to read the image for measurement, and causing the controller to decide density of the image for measurement read by the reading device, and select the block having uniform density along the main scanning direction, in the image for measurement.

6. An inkjet recording apparatus comprising:

an image forming device that ejects ink on a recording medium, thereby forming an image;

a storage device; and a controller, wherein the image forming device includes a first head having a plurality of first nozzles aligned in a straight row, and a second head having a plurality of second nozzles aligned in a straight row, the plurality of first nozzles in the first head are aligned along the main scanning direction, the plurality of second nozzles in the second head are aligned in a same direction in which the plurality of first nozzles are aligned, the first head and the second head are arranged such that a part of the plurality of first nozzles and a part of the plurality of second nozzles are located adjacent to each other, with a spacing in the conveying direction, the storage device contains, in advance, image data including combination patterns of droplet sizes, different with respect to each of blocks extending along the main scanning direction, and the controller is configured to:

(i) cause the image forming device to form the image for measurement on the recording medium, using the image data stored in the storage device;

(ii) select the block having uniform density along the main scanning direction, in the image for measurement; and (iii) determine the nozzle overlapping width using a droplet size ratio adopted to form the image for measurement, on a basis of a position of the selected block.

* * * * *